US008316490B1

(12) United States Patent
Bilak et al.

(10) Patent No.: US 8,316,490 B1
(45) Date of Patent: Nov. 27, 2012

(54) DIAPER CHANGING PAD

(76) Inventors: Tarra Ruth Bilak, Fuquay-Varina, NC (US); Mark Ronald Bilak, Fuquay-Varina, NC (US)

( * ) Notice: Subject to any disclaimer, the term of this patent is extended or adjusted under 35 U.S.C. 154(b) by 236 days.

(21) Appl. No.: 12/838,411

(22) Filed: Jul. 16, 2010

(51) Int. Cl.
*A47D 5/00* (2006.01)

(52) U.S. Cl. ..... 5/655; 5/93.2

(58) Field of Classification Search ..... 5/655, 417, 5/420, 93.2, 94; 297/230.1, 230.11, 230.12
See application file for complete search history.

(56) References Cited

U.S. PATENT DOCUMENTS

| | | | | |
|---|---|---|---|---|
| 4,123,809 | A * | 11/1978 | Pugh | 4/659 |
| 4,466,146 | A | 8/1984 | Regan | |
| 4,788,726 | A | 12/1988 | Rafalko | |
| 4,935,973 | A | 6/1990 | Behrman | |
| 5,265,292 | A * | 11/1993 | Underell | 5/419 |
| 5,333,769 | A | 8/1994 | Skroski | |
| 5,778,465 | A * | 7/1998 | Myers | 5/99.1 |
| 6,272,704 | B1 * | 8/2001 | Cutler | 5/655 |
| 6,327,726 | B1 | 12/2001 | Weber | |
| 6,389,624 | B1 * | 5/2002 | Madole | 5/655 |
| 6,428,098 | B1 | 8/2002 | Allbaugh | |
| 7,065,814 | B2 * | 6/2006 | Rutkowski | 5/655 |
| 7,178,877 | B2 | 2/2007 | Watson | |
| 7,363,667 | B2 | 4/2008 | Borror et al. | |
| 7,520,010 | B2 * | 4/2009 | Welch | 5/655 |
| 7,618,055 | B2 | 11/2009 | Chuah et al. | |
| 8,069,517 | B1 * | 12/2011 | Bush et al. | 5/655 |
| 2006/0150324 | A1 | 7/2006 | Jackson et al. | |
| 2008/0016623 | A1 | 1/2008 | Gold et al. | |
| 2009/0178203 | A1 | 7/2009 | Homan | |
| 2009/0178204 | A1 | 7/2009 | Sager | |

FOREIGN PATENT DOCUMENTS

| | | | |
|---|---|---|---|
| GB | 2 378 380 | A | 12/2003 |

* cited by examiner

*Primary Examiner* — Michael Trettel

(57) ABSTRACT

A diaper changing device to mount to an infant car seat includes a cover having a first side, a second side, a plurality of individualized compartments spaced along a length of the cover and folding sections positioned between adjacent ones of the plurality of individualized compartments. The diaper changing device further includes a plurality of support members positioned within the individualized compartments and a plurality of fasteners attached to the cover. The plurality of fasteners are shaped to engage a lip formed on an edge of the infant car seat to secure the cover to the infant car seat in a position suspended over an interior region of the infant car seat with the second side of the cover facing the interior region and the first side of the cover facing outward.

20 Claims, 14 Drawing Sheets

FIG. 3

DIAPER CHANGING PAD

BACKGROUND

Infants require frequent diaper changes. Diaper changes are often needed when away from home and a sanitary diaper changing station is unavailable. The infant is typically placed on a surface that may be unclean e.g. at a public restroom, hotel, shopping center, airport, park, etc. The caregiver typically places a pad, blanket, etc. on the changing surface to ensure cleanliness. Conventional changing pads are unfolded or unrolled onto the surface in an unsecured manner. That is, the diaper changing pad is free to move about. The changing surface may be unstable, presenting a safety hazard to the infant especially when the surface is elevated. In addition to the safety risk posed to the infant, the changing pad comes into contact with what is often a dirty surface. The changing pad therefore becomes soiled and requires frequent cleaning. When traveling in an automobile, an infant is typically removed from both the infant car seat and the automobile for diaper changes because there is insufficient space in the automobile to change a diaper. However, the environment outside the automobile may be unsafe and present a security risk to the infant and caregiver.

SUMMARY

According to the embodiments described herein, a diaper changing device is mounted to an infant car seat so that an infant may have its diaper changed when placed on the diaper changing device. The diaper changing device is suspended over an interior region of the infant car seat when mounted to the car seat, the interior region being where the infant is placed in the car seat. The diaper changing device is mounted to the infant car seat after the infant is removed from the car seat. The diaper changing device includes support members or panels having a rigidity to support the infant above the interior region of the infant car seat when the diaper changing device is mounted to the car seat in an unfolded position. The diaper changing device can be readily folded up when not in use for compact storage, transport, etc.

According to an embodiment of a diaper changing device to mount to an infant car seat, the device includes a cover, a plurality of support members and a plurality of fasteners. The cover has a first side, a second side, a plurality of individualized compartments spaced along a length of the cover and folding sections positioned between adjacent ones of the plurality of individualized compartments. The support members are positioned within the individualized compartments. The fasteners are attached to the cover and shaped to engage a lip formed on an edge of the infant car seat to secure the cover to the infant car seat in a position suspended over an interior region of the infant car seat with the second side of the cover facing the interior region and the first side of the cover facing outward.

According to an embodiment of a method of mounting a diaper changing device to an infant car seat, the method includes providing a diaper changing device comprising a cover having a first side, a second side, a plurality of individualized compartments spaced along a length of the cover and folding sections positioned between adjacent ones of the individualized compartments. The diaper changing device further includes a plurality of support members positioned within the individualized compartments and a plurality of fasteners attached to the cover and shaped to engage a lip formed on an edge of the infant car seat. The method further comprises attaching the fasteners to the lip of the infant car seat to secure the cover to the infant car seat in a position suspended over an interior region of the infant car seat with the second side of the cover facing the interior region and the first side of the cover facing outward.

According to another embodiment of a diaper changing device to mount to an infant car seat, the device includes a plurality of panels and a fastener attached to at least two of the plurality of panels. The panels have a rigidity to support an infant above an interior of the infant car seat. The panels being are attached together to be moveable relative to each other, each panel having a first side and a second side. The panels are positionable between an extended orientation with the panels spread apart in a side-by-side orientation with the first sides of each panel facing in a common direction, and a folded orientation with each of the panels stacked together in an overlapping arrangement with at least the first side of one panel facing toward the first side of an adjacent panel. The panels have a greater length in the extended orientation than in the folded orientation and a width that is the same in both orientations. Each fastener is shaped to engage a lip formed on an edge of the infant car seat to secure the diaper changing device to the infant car seat in the unfolded orientation suspended over an interior region of the infant car seat.

Of course, the present invention is not limited to the above features and advantages. Those skilled in the art will recognize additional features and advantages upon reading the following detailed description, and upon viewing the accompanying drawings.

DRAWING DESCRIPTIONS

The accompanying drawings are included to provide a further understanding of embodiments and are incorporated in and constitute a part of this specification. The drawings illustrate embodiments and together with the detailed description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

Features and advantages of embodiments will be apparent from the following description with reference to the accompanying drawings. The drawings are not necessarily to scale and emphasis is placed upon illustrating the principles. The features of the various illustrated embodiments can be combined in any way unless they exclude each other.

WRITTEN DESCRIPTION

Figure 1:
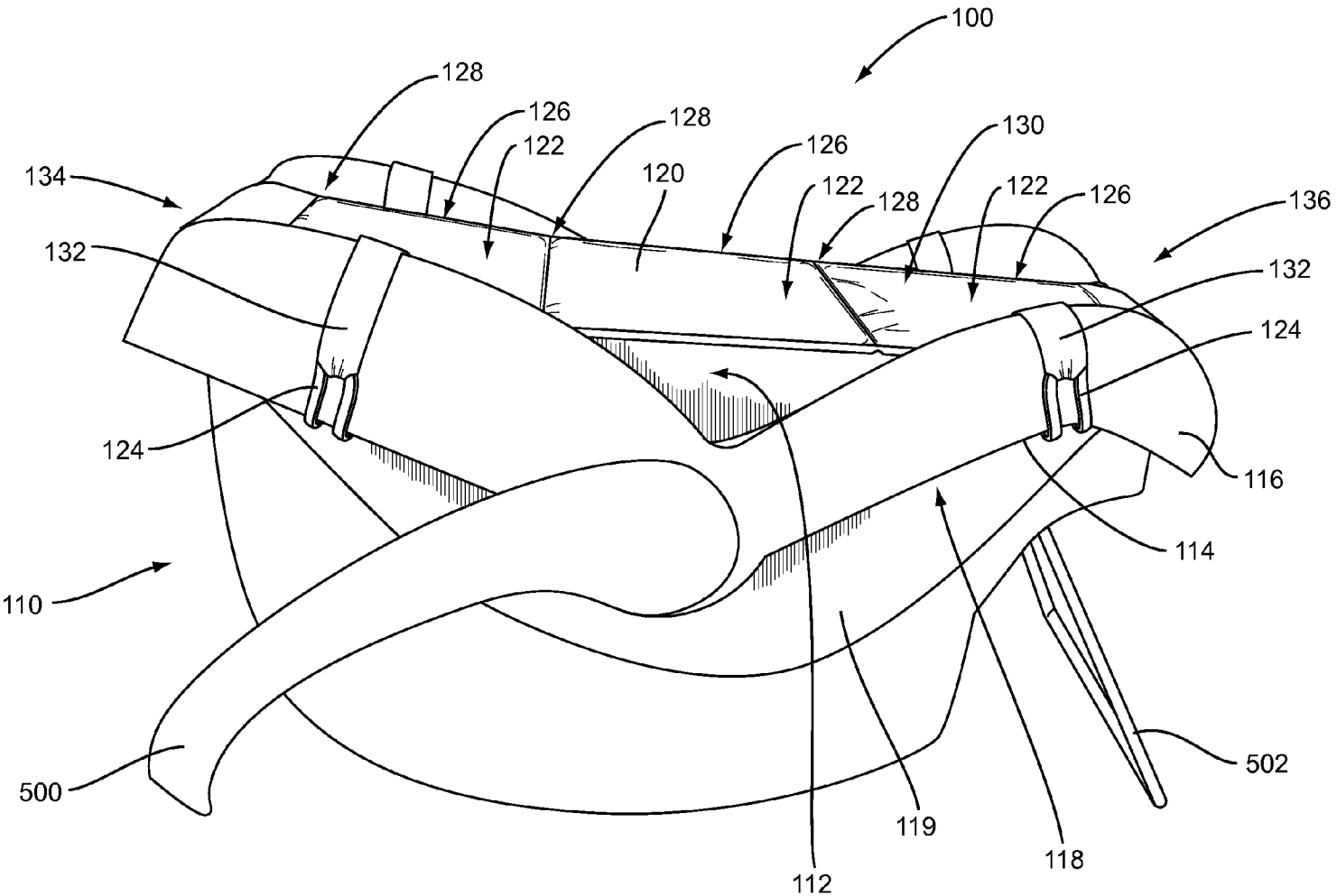
FIG. 1 illustrates one embodiment of a diaper changing device mounted to an infant car seat.

FIG. 1 illustrates one embodiment of a diaper changing device 100 mounted to an infant car seat 110 for supporting an infant when changing a diaper. The infant is removed from the car seat 110 prior to mounting of the diaper changing device 100, and is not shown for ease of illustration. The diaper changing device 100 therefore does not interfere with or otherwise inhibit the safety features of the infant car seat 110. The diaper changing device 100 includes a cover 120, a plurality of support members 122 and a plurality of fasteners 124. The cover 120 has a plurality of individualized compartments 126 spaced along the length of the cover 120 and folding sections 128 positioned between adjacent ones of the individualized compartments 126. The folding sections 128 permit the cover 120 to be folded into a more compact configuration when not in use e.g. for ease of transport, storage, etc. The bottom side of the cover 120 faces an open interior region 112 of the infant car seat 110 and is out of view in FIG. 1, the interior region 112 being where an infant is received when placed in the car seat 110. The opposing top side 130 of the cover 120 faces outward from the interior region 112 of the infant car seat 110 and is the side of the cover 120 on which the infant is placed when changing a diaper.

In general, the cover 120 can be made of any desirable material or materials. In one embodiment, the cover 120 is made of a synthetic, non-synthetic or blended fabric material. The top side 130 of the cover 120 can be made of a material impermeable to liquids such as vinyl, rubber, etc. to protect the cover 120 from liquids on the outer surface. The top side 130 of the cover 120 can have a roughened, bumpy, or otherwise high-friction surface to increase the surface friction between the infant and the cover 120 so that the infant does not slide off the diaper changing device 100 when in use.

The support members 122 are positioned within the individualized compartments 126 of the cover 120 according to the embodiment shown in FIG. 1. Each support member can extend lengthwise over the width of the device 100 as shown in FIG. 1 or over the length of the device 100 as shown in other Figures. In one embodiment, the support members 122 are relatively rigid panels made of wood, plastic, composite material, or any other material or materials suitable for supporting an infant placed on the diaper changing device 100 when the changing device 100 is mounted to the infant car seat 110 in a suspended position over the open interior region 112 of the car seat 110. The support members 122 can be relatively flat, curved or have any other desired shape. Any desirable number of support members 122 can be included in the cover 120.

Figure 2:
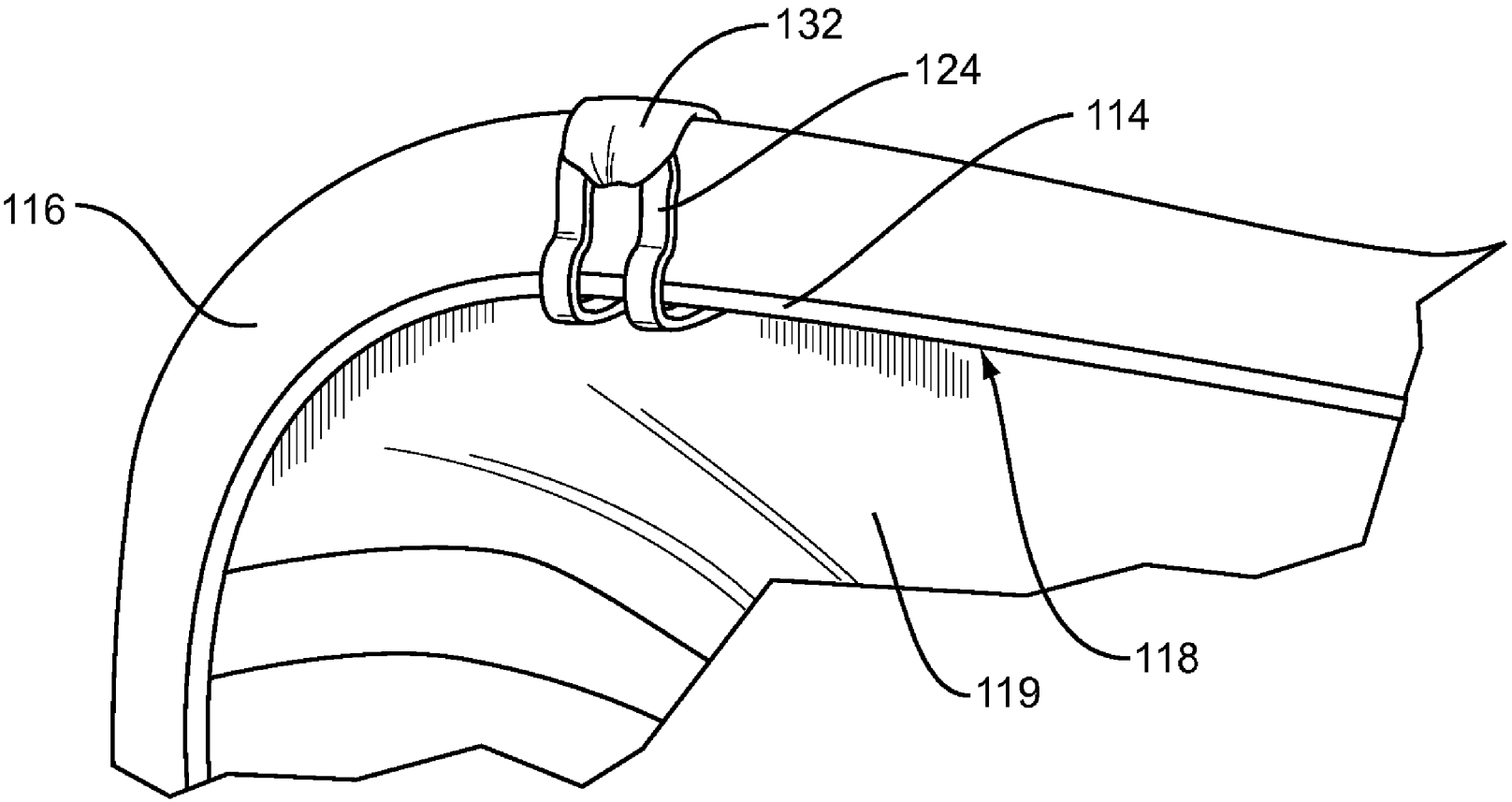
FIG. 2 illustrates one embodiment of a fastener of the diaper changing device of FIG. 1 engaging a lip formed on an edge of the infant car seat.

The fasteners 124 secure the cover 120 to the infant car seat 110 so that the diaper changing device 100 is mounted to the car seat 110 suspended over the open interior region 112 of the car seat 110. The fasteners 124 are shaped to engage a lip 114 formed on an edge 116 of the infant car seat 110. FIG. 2 shows an exploded view of one fastener 124 engaging the lip 114 of the infant car seat 110. The fasteners 124 can be any suitable shape for engaging the lip 114 of the infant car seat 110 so that the diaper changing device 100 is securely mounted to the car seat 110 in a suspended position over the interior region 112 of the car seat 110. In one embodiment, the fasteners 124 are hooks as shown in FIG. 2.

The fasteners 124 can be attached to the cover 120 via straps or bands 132 which can be made of a non-elastic material, semi-elastic material, elastic material or any other type of material. The straps/bands 132 can be wide or narrow depending on the size and shape of the fasteners 124. Some or all of the fasteners 124 can be directly attached to the cover i.e. no strap or band is used for fixing the fasteners 124 to the cover 120. For example, fasteners 124 positioned at the head end 134 and/or the tail end 136 of the diaper changing device 100 can be attached directly to the cover 120 while fasteners 124 positioned at the sides of the diaper changing device 100 can be attached to the cover 120 via straps or bands 132.

Figure 3:
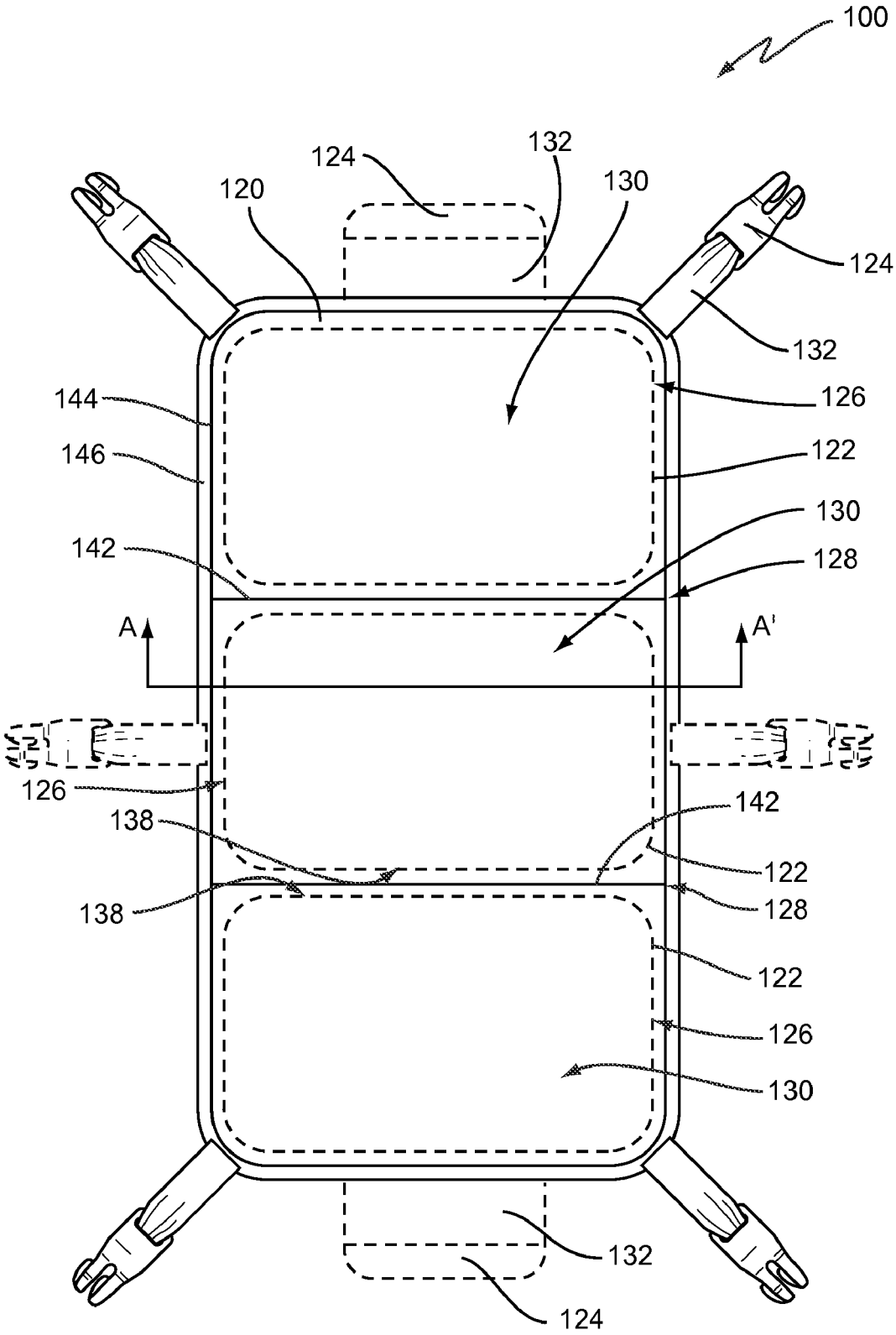
FIGS. 3-5 illustrate another embodiment of a diaper changing device in folded, partially folded and unfolded positions.
Figure 4:
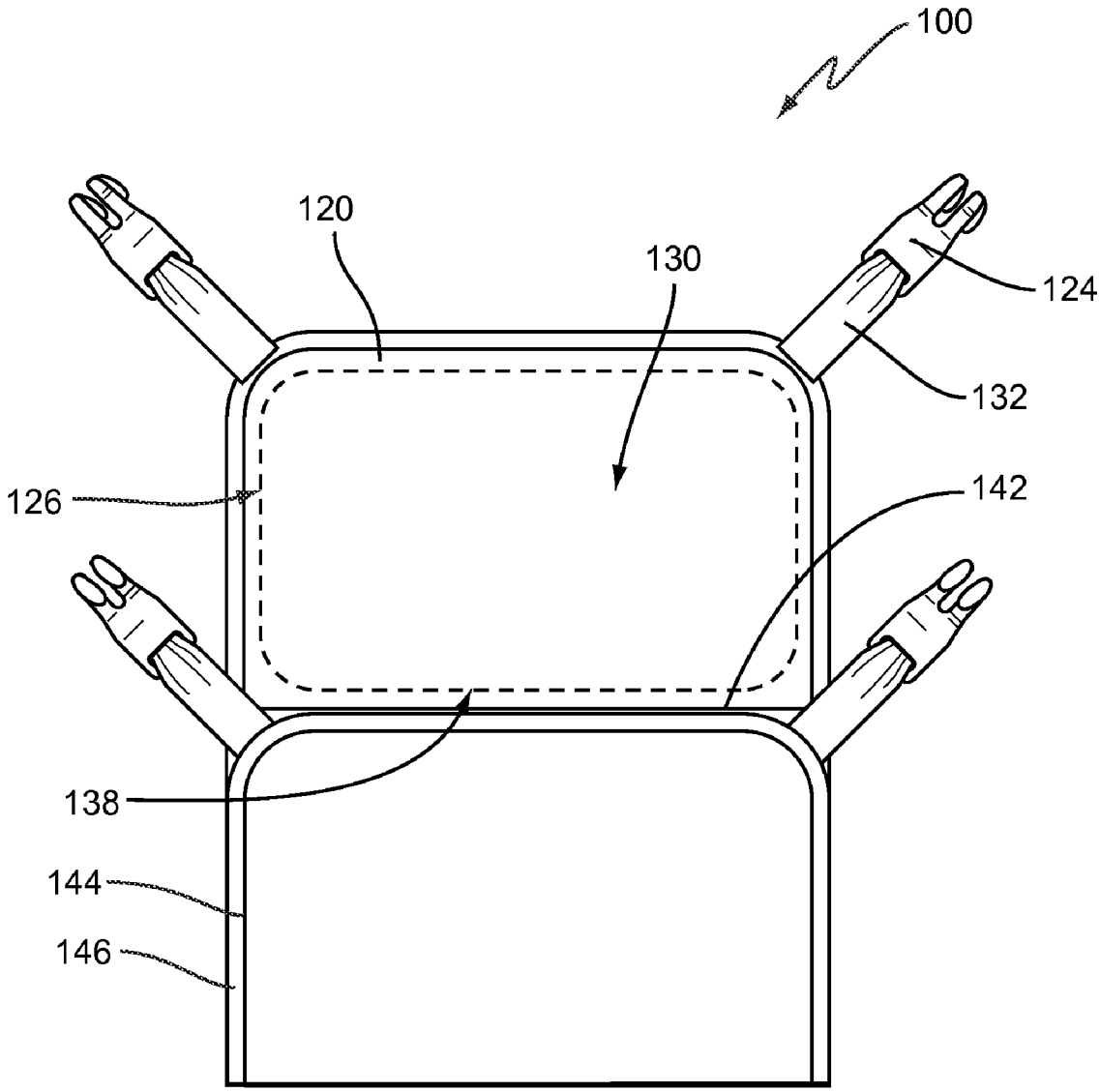
Figure 5:
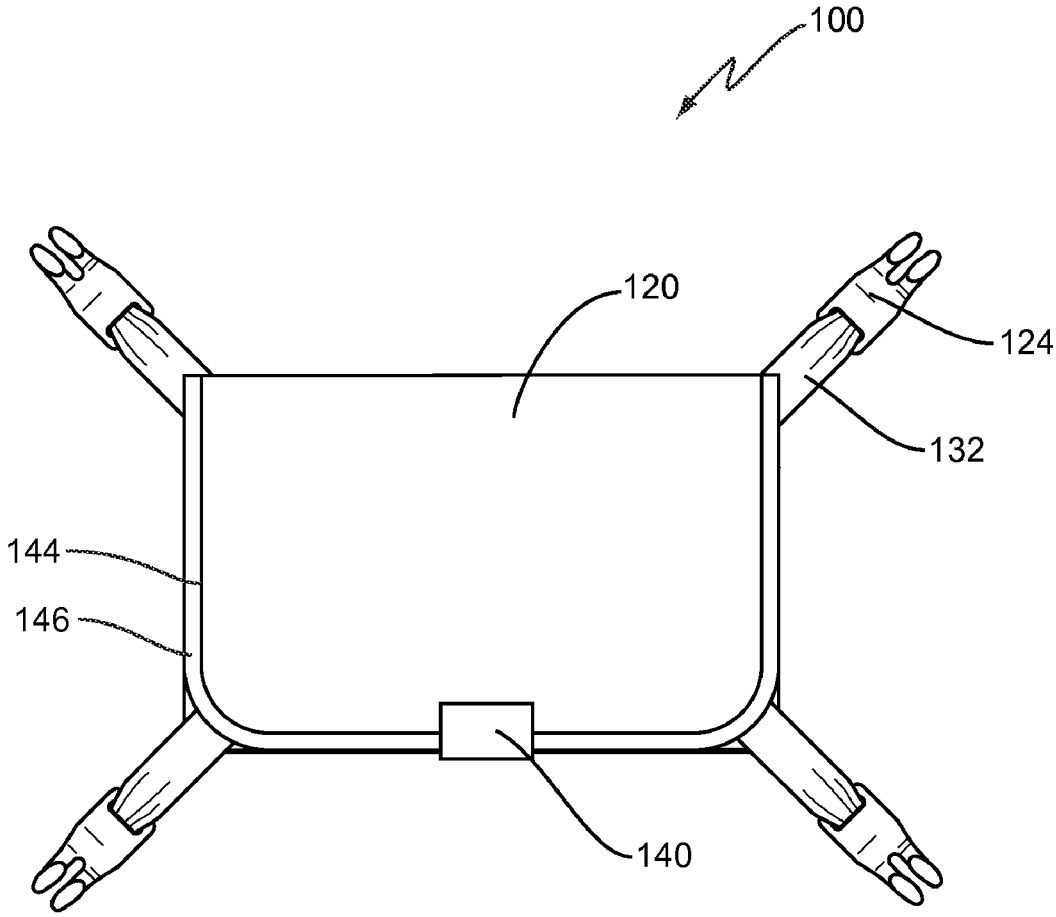

FIG. 3 shows a top-down plan view of an embodiment of the diaper changing device 100 in an unfolded position. FIG. 4 shows the diaper changing device 100 in a partially folded position and FIG. 5 shows the diaper changing device 100 in a folded position. The support members 122 of the diaper changing device 100 are shown with dashed lines in FIGS. 3-5 because the support members 122 are inserted in the individualized compartments of the cover 120 according to this embodiment, as described above. FIG. 3 shows the diaper changing device 100 in the unfolded position with the support members 122 arranged end-to-end over the length of the cover 120 with the top sides of each support member 122 generally facing in the same direction, the top side of each support member 122 being the side of the support member 122 adjacent an infant when placed on the diaper changing device 100. The support members 122 are moveable relative to each other and positionable in an extended orientation with the support members 122 spread apart in a side-by-side orientation with adjacent lateral sides 138 of each support member 122 facing in a common direction as shown in FIG. 3.

FIG. 4 shows the diaper changing device 100 in the partially folded position. The top side of one support member 122 faces the top side of an adjacent support member 122 in the partially folded position.

FIG. 5 shows the diaper changing device 100 in the folded position with each of the support members 122 stacked together in an overlapping arrangement. The top side of one support member 122 faces toward the top side of an adjacent support member 122 in the folded position. In one embodiment, the support members 122 are stacked one over the other and spaced apart from one another by a portion of the cover 120. The support members 122 have a greater length in the extended orientation (i.e. the unfolded position) than in the folded orientation. The width of the support members 122 is the same in both orientations. In one embodiment, one or more of the support members 122 has a relatively flat shape which is maintained in the folded and unfolded orientations. A securing mechanism 140 such as a VELCRO® fastener can be used to maintain the diaper changing device 100 in the folded position as shown in FIG. 5.

The diaper changing device 100 is mounted to the infant car seat 110 in the unfolded position (i.e. the extended orientation) illustrated in FIG. 3. In general, the fasteners 124 used to mount the diaper changing device 100 to the infant car seat 110 can be oriented at any position along the perimeter of the cover 120. That is, the fasteners 124 can be attached to the head and/or tail ends 134/136 of the cover 120, the sides of the cover 120, and/or any of the corner regions of the cover 120 as indicated in FIG. 3 by some of the straps/bands 132 having solid lines while others have dashed lines. FIG. 3 illustrates a purely non-limiting exemplary embodiment of the diaper changing device 100, and should not be construed in any way as limiting the placement of the fasteners 124 to a particular orientation with respect to the cover 120. Optimal placement of the fasteners 124 depends on a number of factors e.g. such as size, shape and construction of the infant car seat 110, size, shape and construction of the diaper changing device 100, etc. Any fastener placement configuration with respect to the cover 120 is considered to be within the scope of the various embodiments described herein.

FIGS. 3-5 show the cover 120 having a plurality of seams 142 extending between the top and bottom sides of the cover 120. Each seam 142 separates adjacent ones of the individualized compartments 126 and runs generally parallel with the corresponding folding section 128. The seams 142 physically separate adjacent support members 122. The cover 120 can further include a perimeter seam 144 defining the perimeter 146 of the cover 120. The fasteners 124 can be attached to the perimeter 146 of the cover 120 formed by the perimeter seam 144 as shown in FIGS. 3-5, or attached to any other section of the cover 120. The perimeter 146 of the cover 120 can be as narrow or wide as desired e.g. so that the support members 122 are suspended at a desired depth below the edge of the infant car seat 110 when the diaper changing device 100 is mounted to the car seat 110 using the fasteners 124.

Figure 6:
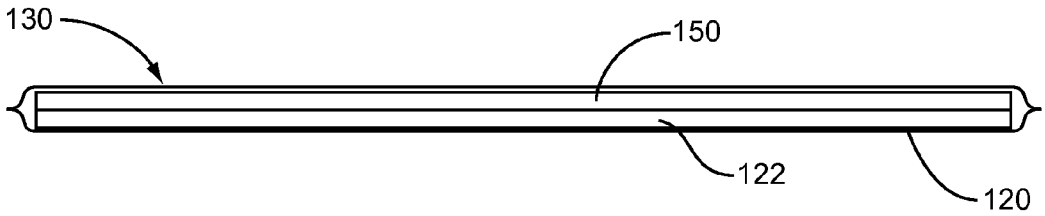
FIG. 6 illustrates a schematic cross-sectional view of the diaper changing device in FIGS. 3-5.

FIG. 6 illustrates a cross-sectional view of the diaper changing device 100 shown in FIGS. 3-5 along the line labeled A'A' in FIG. 3. According to this embodiment, padding 150 is positioned between each support member 122 and the top side 130 of the cover 120. The padding 150 provides cushioned support for the infant. The optional padding 150 can be excluded if desired.

Figure 7:
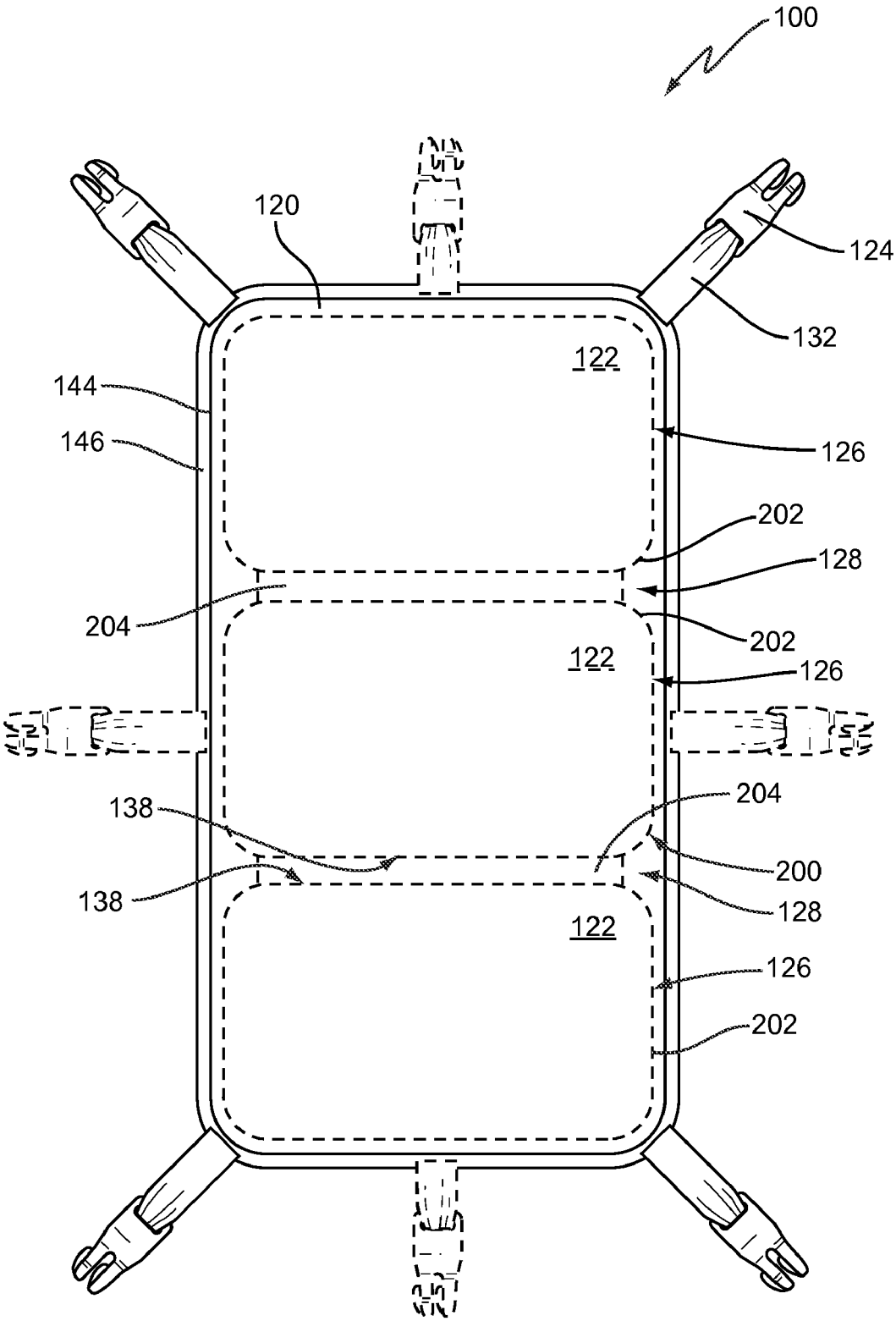
FIG. 7 illustrates another embodiment of a diaper changing device.

FIG. 7 illustrates another embodiment of the diaper changing device 100. According to this embodiment, a continuous material 200 e.g. made of plastic or other relatively rigid material has thicker regions 202 which form the support members 122 and thinner regions 204 between the thicker regions 202. The thinner regions 204 of the continuous material 200 attach adjacent ones of the thicker regions 202. This way, adjacent lateral sides 138 of the support members 122 are spaced apart from one another so that the diaper changing device 100 can be moved into the folded position, but are also connected to one another by the thinner intermediary regions 202 of the continuous material 200.

Figure 8:
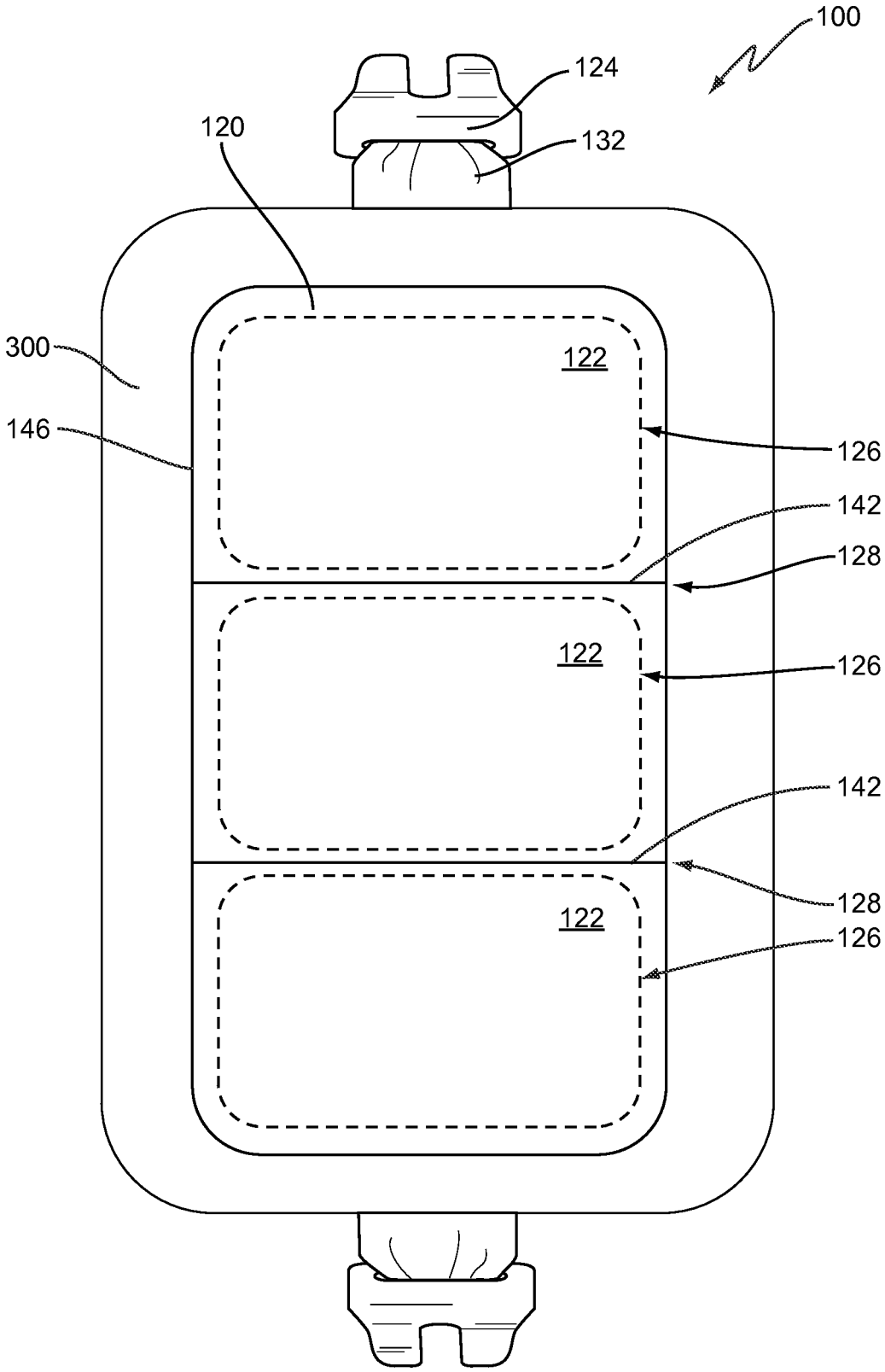
FIG. 8 illustrates yet another embodiment of a diaper changing device.

FIG. 8 illustrates yet another embodiment of the diaper changing device 100. According to this embodiment, the cover 120 includes a band of flexible material 300 around the perimeter 146 of the cover 120. The fasteners 124 are directly attached to the band of flexible material 300 instead of the perimeter 146 of the cover 120.

Figure 9:
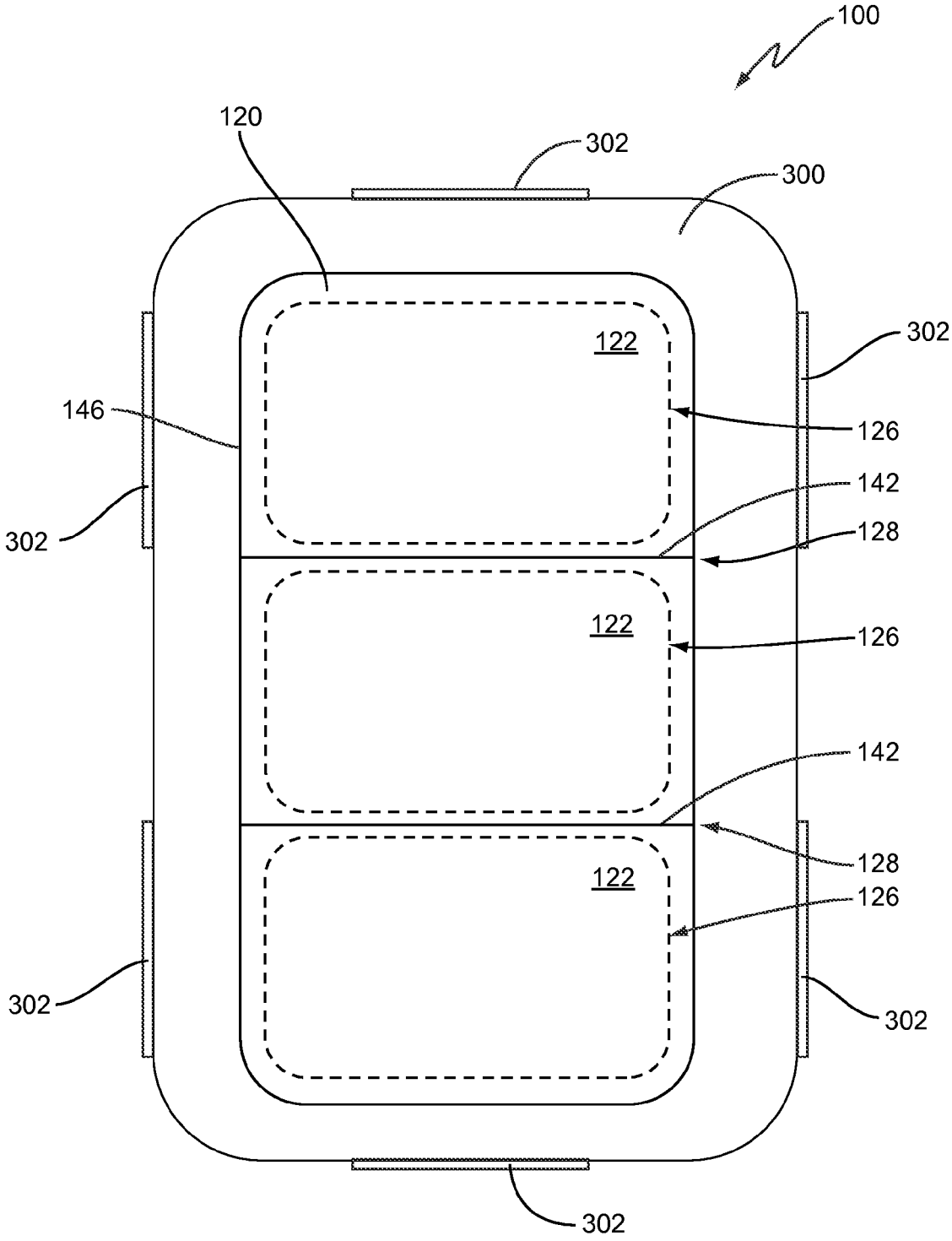
FIG. 9 illustrates still another embodiment of a diaper changing device.

FIG. 9 illustrates still another embodiment of the diaper changing device 100. According to this embodiment, the fasteners are tabs 302 e.g. made or plastic or other relatively rigid material attached to the cover 120. In one embodiment, the tabs 302 are attached to the band of flexible material 300 bordering the perimeter 146 of the cover 120 as shown in FIG. 9. In another embodiment, the optional band of flexible material 300 is excluded and the tabs 302 are attached directly to the perimeter 146 of the cover 120. In either case, the tabs 302 are shaped for insertion in a gap 118 between the lip 114 formed on the edge 116 of the infant car seat 110 and the body 119 of the infant car seat 110 e.g. by pushing the tabs 302 toward the body 119 of the infant car seat 110 when the diaper changing device 100 is placed in position over the car seat 110 so that the tabs 302 are forced into the gap 118 between the lip 114 and the body 119 of the car seat 110.

Figure 10:
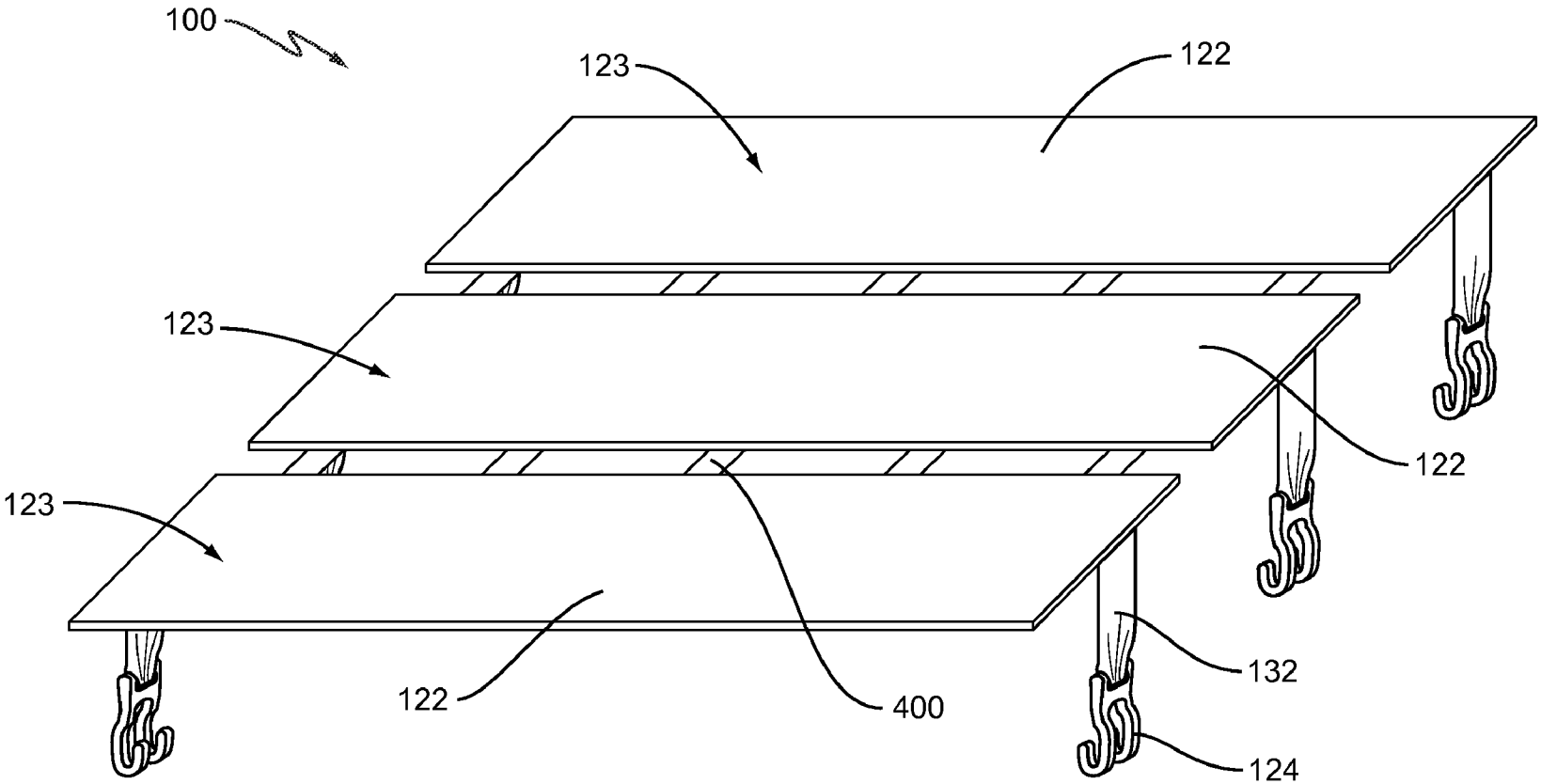
FIGS. 10-12 illustrate an embodiment of a diaper changing device with no cover in folded, partially folded and unfolded positions.
Figure 11:
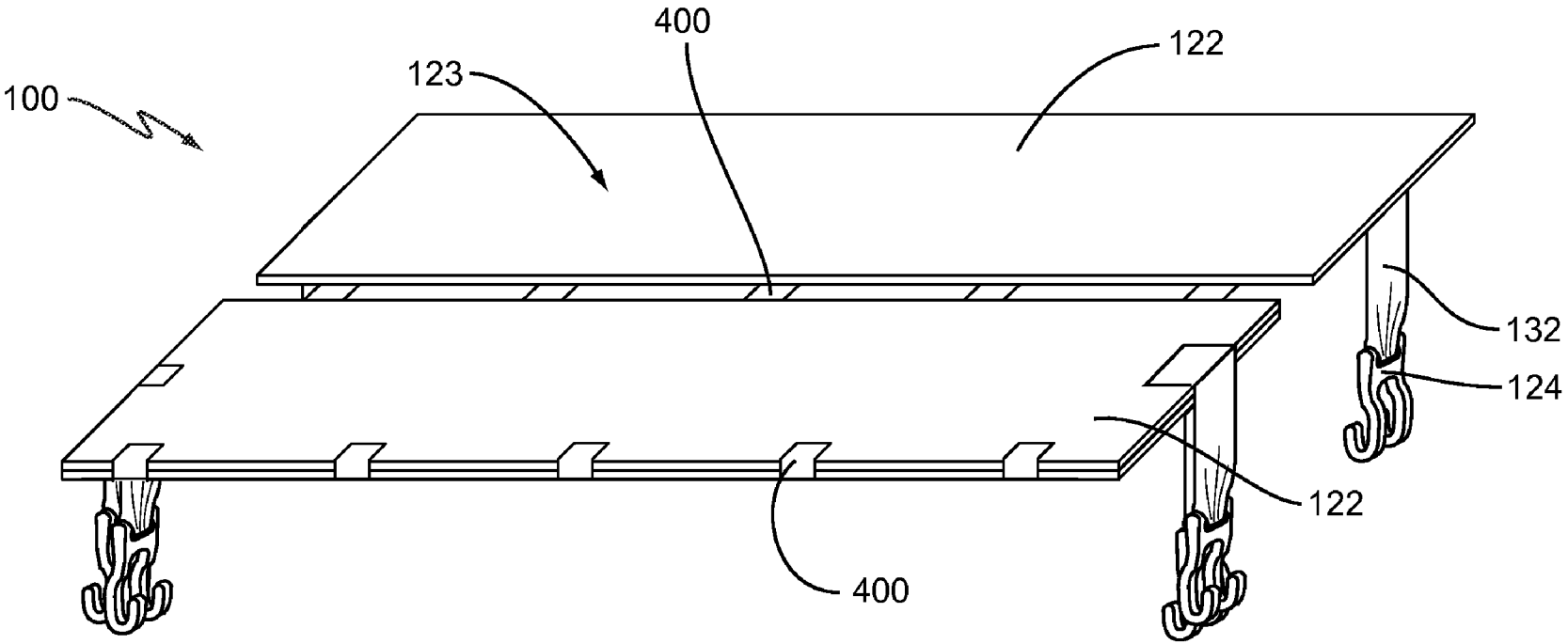
Figure 12:
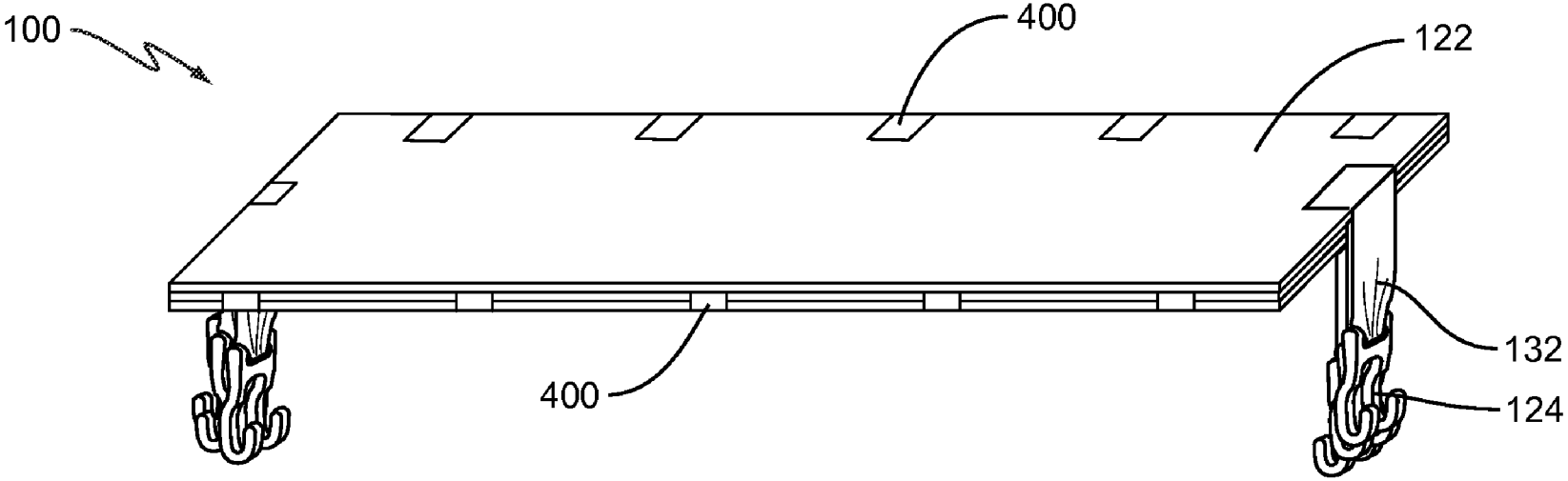

FIG. 10 shows a top-down plan view of another embodiment of the diaper changing device 100 in the unfolded position. FIG. 11 shows the diaper changing device 100 in the partially folded position and FIG. 12 shows the diaper changing device 100 in the folded position. The diaper changing device 100 does not include a cover according to the embodiment shown in FIGS. 10-12. Instead, the support members 122 of the diaper changing device 100 have a rigidity to support an infant above the interior region 112 of the infant car seat 110 and are attached together by bands or straps 400 so that the support members 122 can move relative to each other.

The support members 122 are spread apart in a side-by-side orientation with the respective top sides 123 of the support members 122 facing in a common direction when positioned in the unfolded position as shown in FIG. 10, the top side 123 of each support member 122 being the side of the support member 122 adjacent an infant when placed on the diaper changing device 100. The support members 122 have a relatively flat shape according to one embodiment, and maintain the relatively flat shape in the folded and unfolded orientations. In general, the support members may have any desired shape and rigidity.

FIG. 11 shows the diaper changing device 100 in the partially folded position. The top side 123 of one support member 122 faces the top side 123 of an adjacent support member 122 in the partially folded position.

FIG. 12 shows the diaper changing device 100 in the folded orientation. Each of the support members 122 are stacked together in an overlapping arrangement with at least the top side 123 of one support member 122 facing toward the top side 123 of an adjacent support member 122. The support members 122 have a greater length in the extended orientation than in the folded orientation and a width that is the same in both orientations. A fastener 124 is attached to at least two of the support members 122. Each fastener 124 is shaped to engage the lip 114 formed on the edge 116 of the infant car seat 110 so that the diaper changing device 100 can be mounted to the infant car seat 110 in the unfolded orientation suspended over the open interior region 112 of the car seat 110.

Figure 13:
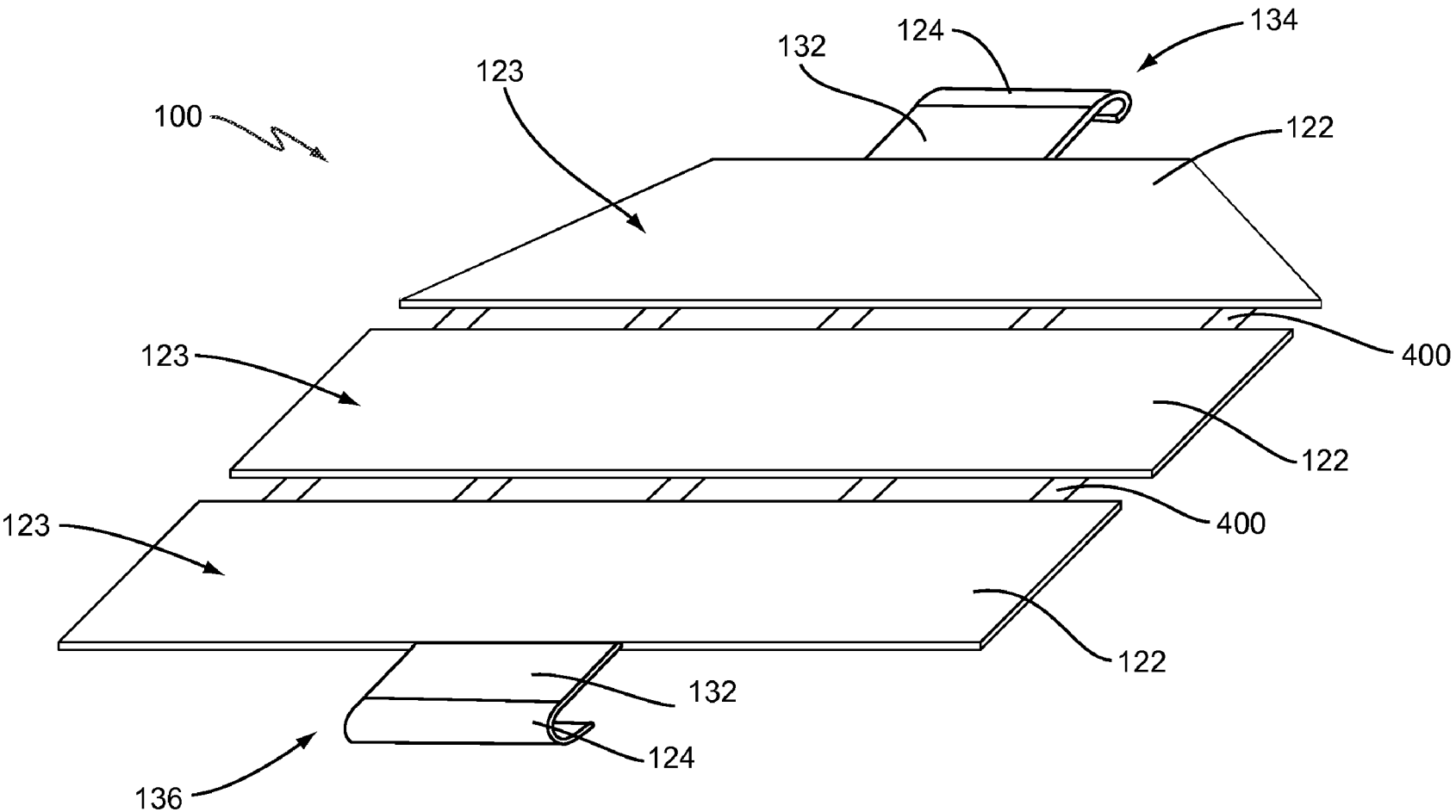
FIG. 13 illustrates another embodiment of a diaper changing device with no cover.

FIG. 13 shows a top-down plan view of another embodiment of the diaper changing device 100 with no cover in the unfolded position. The fasteners 124 are not shown in FIG. 13 for ease of illustration only. The support member 122 positioned at the head end 134 of the diaper changing device 100 is tapered according to this embodiment so that this support member 122 can be at least partly seated inside the head region of the infant car seat 110 e.g. for those types of infant car seats having head regions that narrow gradually. This way, the support member 122 for supporting the head of the infant can be seated below the top of the edge 116 of the infant car seat 110 so that the upper portion of the car seat edge 116 provides a safety bumper that keeps the baby safely positioned on the diaper changing device 100 when in use. One or more of the other support members 122 can also be shaped to sit at least partly below the edge 116 of the infant car seat 110 when in use as shown in FIG. 1 so that the safety bumper created by the upper portion of the car seat edge 116 surrounds all or most of the infant when placed on the diaper changing device 100.

The diaper changing device 100 can be mounted to the infant car seat 110 when the car seat 110 is secured in a corresponding base unit installed in an automobile (not shown). The base prevents the car seat from moving when properly seated in the base. The infant car seat 110 may be part of a combination car seat/stroller unit where the car seat 110 can be securely received by the stroller. This configuration also forms a solid base for securing the car seat 110 when using the diaper changing device 100. In other instances, the infant car seat 110 may not be secured to the base unit or stroller when an infant requires a diaper change. Under these conditions, rocking of the infant car seat 110 can be prevented when using the diaper changing device 100 by moving the carry handle 500 of the infant car seat 110 to a downward facing position. One or more support legs 502 are also moved outward from the body 119 of the car seat as shown in FIG. 1. In this configuration, the handle 500 prevents forward rocking of the infant car seat 110 and the extended leg(s) 502 prevent rearward rocking of the car seat 110. This anti-rocking configuration together with the safety bumper formed by seating at least a portion of the diaper changing device 100 below the top portion of the car seat edge 116 as previously described herein ensures the infant remains securely positioned during a diaper change.

Figure 14:
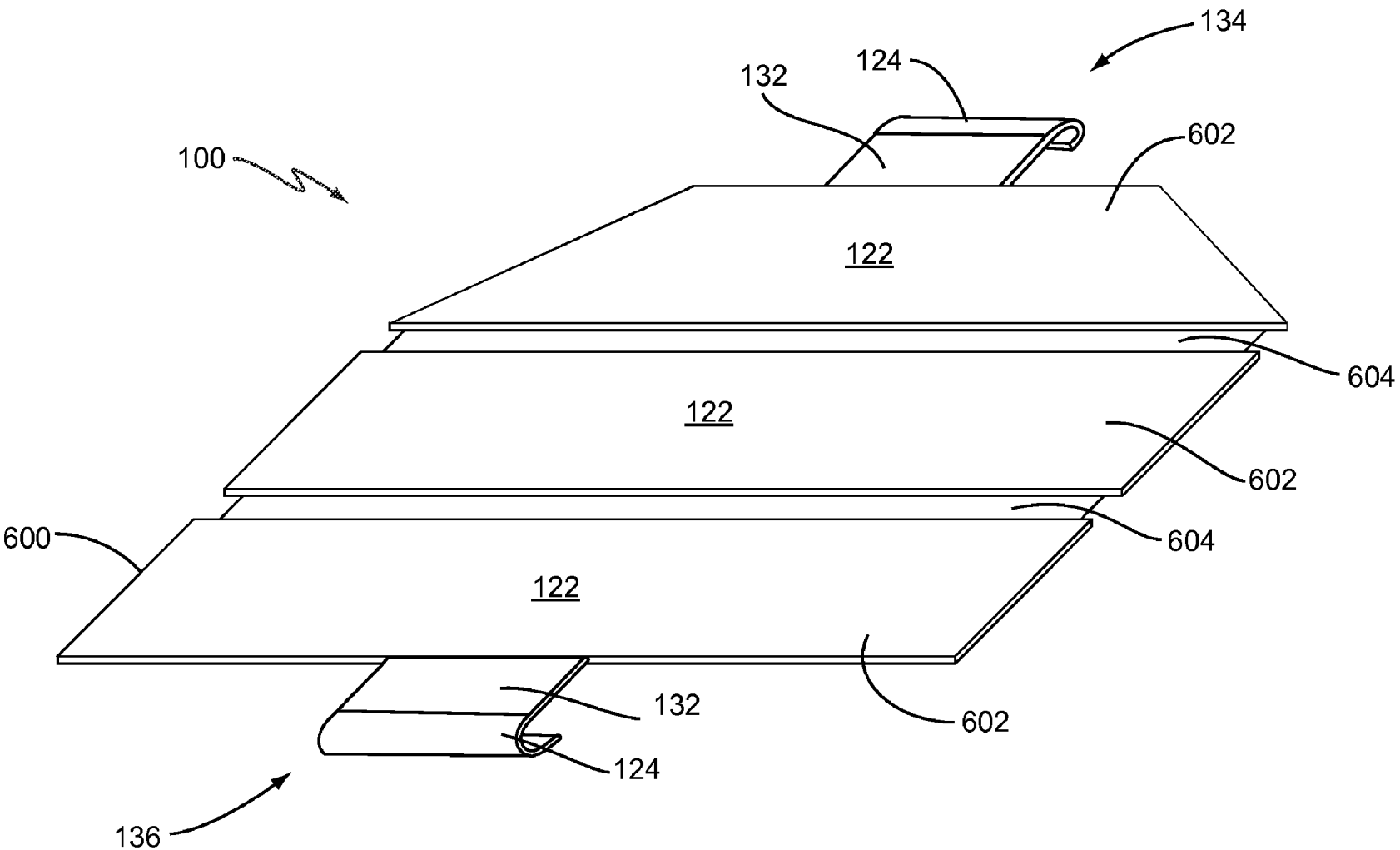
FIG. 14 illustrates another embodiment of a diaper changing device with no cover.

FIG. 14 shows a top-down plan view of another embodiment of the diaper changing device 100 with no cover in the unfolded position. According to this embodiment, a continuous material 600 e.g. made of plastic or other relatively rigid material has thicker regions 602 which form the support members 122 of the diaper changing device 100 and thinner regions 604 interposed between the thicker regions 602. The thinner regions 602 of the material 600 interconnect adjacent ones of the support members 122 and enable the diaper changing device 100 to move into the folded position.

The diaper changing device embodiments illustrated in FIGS. 10-14 can include the cover 120 with the plurality of individualized compartments 125 spaced along the length of the cover 120 and the folding sections 128 positioned between adjacent ones of the individualized compartments 126 as previously described herein. This way, each support member 122 can be positioned inside the cover 120 within one of the individualized compartments 126.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

With the above range of variations and applications in mind, it should be understood that the present invention is not limited by the foregoing description, nor is it limited by the accompanying drawings. Instead, the present invention is limited only by the following claims and their legal equivalents.

What is claimed is:

1. A diaper changing device to mount to an infant car seat, comprising:

a cover having a first side, a second side, a plurality of individualized compartments spaced along a length of the cover and folding sections positioned between adjacent ones of the plurality of individualized compartments;

a plurality of support members positioned within the individualized compartments; and a plurality of fasteners attached to the cover and shaped to engage a lip formed on an edge of the infant car seat to secure the cover to the infant car seat in a position suspended over an interior region of the infant car seat with the second side of the cover facing the interior region and the first side of the cover facing outward.

2. The diaper changing device of claim 1, wherein the cover is made of a fabric material.

3. The diaper changing device of claim 1, wherein the cover includes a plurality of seams extending between the first and second sides of the cover, each of the adjacent ones of the plurality of individualized compartments being separated by one of the seams.

4. The diaper changing device of claim 3, wherein the cover further includes a perimeter seam that extends around a perimeter of the cover, the plurality of fasteners being attached to the perimeter of the cover.

5. The diaper changing device of claim 1, further comprising padding positioned between each support member and the first side of the cover.

6. The diaper changing device of claim 1, wherein the plurality of fasteners are shaped to hook onto the lip formed on the edge of the infant car seat.

7. The diaper changing device of claim 1, wherein the plurality of fasteners are tabs attached to the cover, the tabs shaped to insert in a gap between the lip formed on the edge of the infant car seat and a body of the infant car seat.

8. The diaper changing device of claim 1, wherein adjacent sides of the plurality of support members are spaced apart from one another and connected to one another.

9. The diaper changing device of claim 1, wherein the cover and the plurality of support members move into an unfolded first position with the plurality of support members arranged end-to-end over the length of the cover and into a folded second position with the plurality of support members stacked one over the other and spaced apart from one another by a portion of the cover.

10. The diaper changing device of claim 1, wherein the cover includes a band of flexible material around a perimeter of the cover, the plurality of fasteners being attached to band of flexible material.

11. A diaper changing device to mount to an infant car seat, comprising:

a plurality of panels having a rigidity to support an infant above an interior of the infant car seat, the plurality of panels being attached together to be moveable relative to each other, each of the plurality of panels having a first side and a second side, the plurality of panels positionable between an extended orientation with the panels spread apart in a side-by-side orientation with the first sides of each panel facing in a common direction, and a folded orientation with each of the panels stacked together in an overlapping arrangement with at least the first side of one panel facing toward the first side of an adjacent panel, the plurality of panels having a greater length in the extended orientation than in the folded orientation and a width that is the same in both orientations, wherein adjacent panels are attached together via a plurality of bands; and a fastener attached to at least two of the plurality of panels, each fastener shaped to engage a lip formed on an edge of the infant car seat to secure the diaper changing device to the infant car seat in the unfolded orientation suspended over an interior region of the infant car seat.

12. The diaper changing device of claim 11, wherein the plurality of panels each having a relatively flat shape.

13. The diaper changing device of claim 12, wherein each of the plurality of panels maintains their relatively flat shape in the folded and unfolded orientations.

14. The diaper changing device of claim 11, wherein the plurality of fasteners are shaped to hook onto the lip formed on the edge of the infant car seat.

15. The diaper changing device of claim 11, further comprising a cover having a plurality of individualized compartments spaced along a length of the cover and folding sections positioned between adjacent ones of the plurality of individualized compartments, wherein one of the plurality of panels is positioned within each of the individualized compartments.

16. A diaper changing device to mount to an infant car seat, comprising:

a plurality of panels having a rigidity to support an infant above an interior of the infant car seat, the plurality of panels being attached together to be moveable relative to each other, each of the plurality of panels having a first side and a second side, the plurality of panels positionable between an extended orientation with the panels spread apart in a side-by-side orientation with the first sides of each panel facing in a common direction, and a folded orientation with each of the panels stacked together in an overlapping arrangement with at least the first side of one panel facing toward the first side of an adjacent panel, the plurality of panels having a greater length in the extended orientation than in the folded orientation and a width that is the same in both orientations, wherein a continuous material forms the plurality of panels, the continuous material having thicker regions which form the plurality of panels and thinner regions between adjacent ones of the panels so that the plurality of panels are attached together by the thinner regions of the continuous material; and a fastener attached to at least two of the plurality of panels, each fastener shaped to engage a lip formed on an edge of the infant car seat to secure the diaper changing device to the infant car seat in the unfolded orientation suspended over an interior region of the infant car seat.

17. The diaper changing device of claim 16, wherein the plurality of panels each having a relatively flat shape.

18. The diaper changing device of claim 17, wherein each of the plurality of panels maintains their relatively flat shape in the folded and unfolded orientations.

19. The diaper changing device of claim 16, wherein the plurality of fasteners are shaped to hook onto a lip formed on the edge of the infant car seat.

20. The diaper changing device of claim 16, further comprising a cover having a plurality of individualized compartments spaced along a length of the cover and folding sections positioned between adjacent ones of the plurality of individualized compartments, wherein one of the plurality of panels is positioned within each of the individualized compartments.

* * * * *